US006126252A

United States Patent [19]

Flannery et al.

[11] Patent Number: 6,126,252

[45] Date of Patent: Oct. 3, 2000

[54] WORKSTATION INCORPORATING PIVOTING AND SLIDING DRAWER

[75] Inventors: John P. Flannery, Smiths, Bermuda; Michael T. Lye, Warwick, R.I.; Marc S. Harrison, deceased, late of Portmouth, R.I., by Diana Harrison, executrix; Jane K. Langmuir; Peter Wooding, both of Providence, R.I.

[73] Assignee: Maytag Corporation, Newton, Iowa

[21] Appl. No.: 09/437,425

[22] Filed: Nov. 15, 1999

[51] Int. Cl.[7] ..... A47B 17/06

[52] U.S. Cl. ..... 312/194; 312/197; 312/322

[58] Field of Search ..... 312/194, 195, 312/197, 330.1, 334.1, 310, 311, 322, 323; 108/50.01

[56] References Cited

U.S. PATENT DOCUMENTS

| | | | |
|---|---|---|---|
| 1,010,950 | 12/1911 | Prather . | |
| 1,460,306 | 6/1923 | Anderson . | |
| 1,688,456 | 10/1928 | Dolph | 312/197 |
| 1,976,034 | 10/1934 | Poetsch | 312/322 X |
| 2,092,430 | 9/1937 | Stratton | 312/323 X |
| 2,104,939 | 1/1938 | Whalen | 312/310 X |
| 2,535,112 | 12/1950 | Woody . | |
| 2,608,305 | 8/1952 | Sager . | |
| 2,650,871 | 9/1953 | Holderegger | 312/322 |
| 2,988,413 | 6/1961 | Bergen | 312/195 |
| 3,030,165 | 4/1962 | Nagy | 312/322 X |
| 3,078,133 | 2/1963 | Schauer | 312/322 X |
| 4,842,348 | 6/1989 | Ackeret | 312/323 X |
| 5,226,714 | 7/1993 | Wright | 312/323 |
| 5,348,207 | 9/1994 | Frank | 312/310 X |
| 5,683,154 | 11/1997 | Chang | 312/194 |

FOREIGN PATENT DOCUMENTS

| | | | |
|---|---|---|---|
| 175859 | 3/1922 | United Kingdom | 312/197 |
| 1252873 | 11/1971 | United Kingdom | 312/197 |

*Primary Examiner*—Peter M. Cuomo
*Assistant Examiner*—James O. Hansen
*Attorney, Agent, or Firm*—Everett G. Diederiks, Jr.

[57] ABSTRACT

A workstation includes a countertop having a substantially planar upper surface below which extends an upstanding post that defines a substantially vertical axis. Further arranged under the countertop is a drawer that is interconnected to the upstanding post through a set of rail members. The set of rail members includes a first rail member fixed to the drawer and a second rail member which is slidably interconnected with the first rail member. The second rail member is further rotatably mounted to the upstanding post such that a drawer can slide between extended and retracted positions and also pivot about the vertical axis of the post. The drawer includes a handle which extends across both front and side wall portions of the drawer to enhance maneuvering of the drawer to a desired position.

17 Claims, 2 Drawing Sheets

WORKSTATION INCORPORATING PIVOTING AND SLIDING DRAWER

BACKGROUND OF THE INVENTION

1. Field of the Invention

The present invention pertains to a workstation including a substantially planar countertop and, more particularly, to the incorporation of a pivoting and sliding drawer in a workstation.

2. Discussion of the Prior Art

There are numerous environments wherein countertops, having substantially planar work surfaces, are needed, such as in kitchens, offices, educational facilities and the like. Such a work surface can range from the top of a desk to the counter in a kitchen. Regardless of the particular environment of use, it is widely known to provide various drawers, cabinets and the like beneath a work surface in order to store articles for easy access. In the case of a desk, it is quite common to provide drawers or bins on either side of a central area such that a person can sit in a chair in the central area and access the bins on either side. In such an arrangement, the length of the desk and the spacing between the storage drawers are important design considerations. That is, there must be provided ample space in the central area between the drawers in order to enable the user to be comfortably positioned on a chair in the central area. However, it is also desirable to maintain the spacing in a reasonable range in order to assure that the various compartments defined by the drawers are easily accessible.

In these known arrangements, it is most common to find drawers slidably supported for movement between extended and retracted positions. Drawers of this kind are generally supported between vertical, inner and outer panels extending below the planar work surface. Typically, the innermost panels further define the central area into which a user's legs and feet can extend. With such an arrangement, the central area is generally boxed off, with 90° corners being established at the front of the central area. It is not uncommon for a swiveling chair or the like to abut these comers and become damaged over time or for a user's leg to bang against these comers of the desk. Again, these problems exist in numerous types of workstation environments beyond the conventional desk scenario discussed above.

Based on the above, there exists a need in the art for a workstation arrangement including a countertop having a substantially planar upper work surface and one or more storage drawers or bins arranged below the work surface, wherein the drawers are spaced farther apart and preferably angled with respect to one another so as to provide an enlarged central sitting zone for a user. More particularly, there is a need for a workstation including at least one drawer constructed and mounted in such a fashion which will enable the drawer to not only be slid between extended and retracted positions, but which will also enable the drawer to be selectively pivoted towards and away from an adjacent workstation zone.

SUMMARY OF THE INVENTION

The present invention is directed to a workstation having a countertop defined by a substantially planar upper work surface that is supported above a floor in a substantially horizontal plane. Beneath the countertop is arranged one or more drawers that define internal storage compartments. Each drawer is are mounted upon rails which enable the drawer to slide between extended and retracted positions. In addition, the rails are mounted for pivotal movement relative to the countertop about a generally vertical axis. Therefore, each of the drawers can be both pulled out and pivoted to enhance access to within the storage compartment of the drawer, while also enabling the drawer to be retracted and pivoted to a unobstructing position associated with the workstation.

In accordance with a preferred embodiment of the invention, the workstation defines a corner unit having opposing side drawers each slidably mounted through the use of upper and lower rails secured to a single side of the drawer. In the most preferred form of the invention, a remote side of the drawer is formed with recesses into which the rails extend in order to enable the drawers to be positioned directly against side panel surfaces of a countertop base. The rails are also pivotably mounted about respective upstanding posts to enable the drawer to swing laterally inwardly and outwardly. Handles for the drawers preferably extend along both front and inner side surfaces thereof to further enhance accessibility to storage compartments of the drawers.

With this arrangement, a central zone between the drawers is enlarged for convenience of the user. In at least the case of a corner workstation arrangement, the central zone between the drawers diverges outwardly for the further convenience of the user, particularly when the workstation is used in combination with a chair. Since the handles associated with the drawers extend across respective front and side portions, the drawer can be readily manipulated as needed.

Additional objects, features and advantages of the present invention will become more readily apparent from the following detailed description of a preferred embodiment thereof when taken in conjunction with the drawings wherein like reference numerals refer to corresponding parts in the several views.

DETAILED DESCRIPTION OF THE PREFERRED EMBODIMENT

Figure 1:
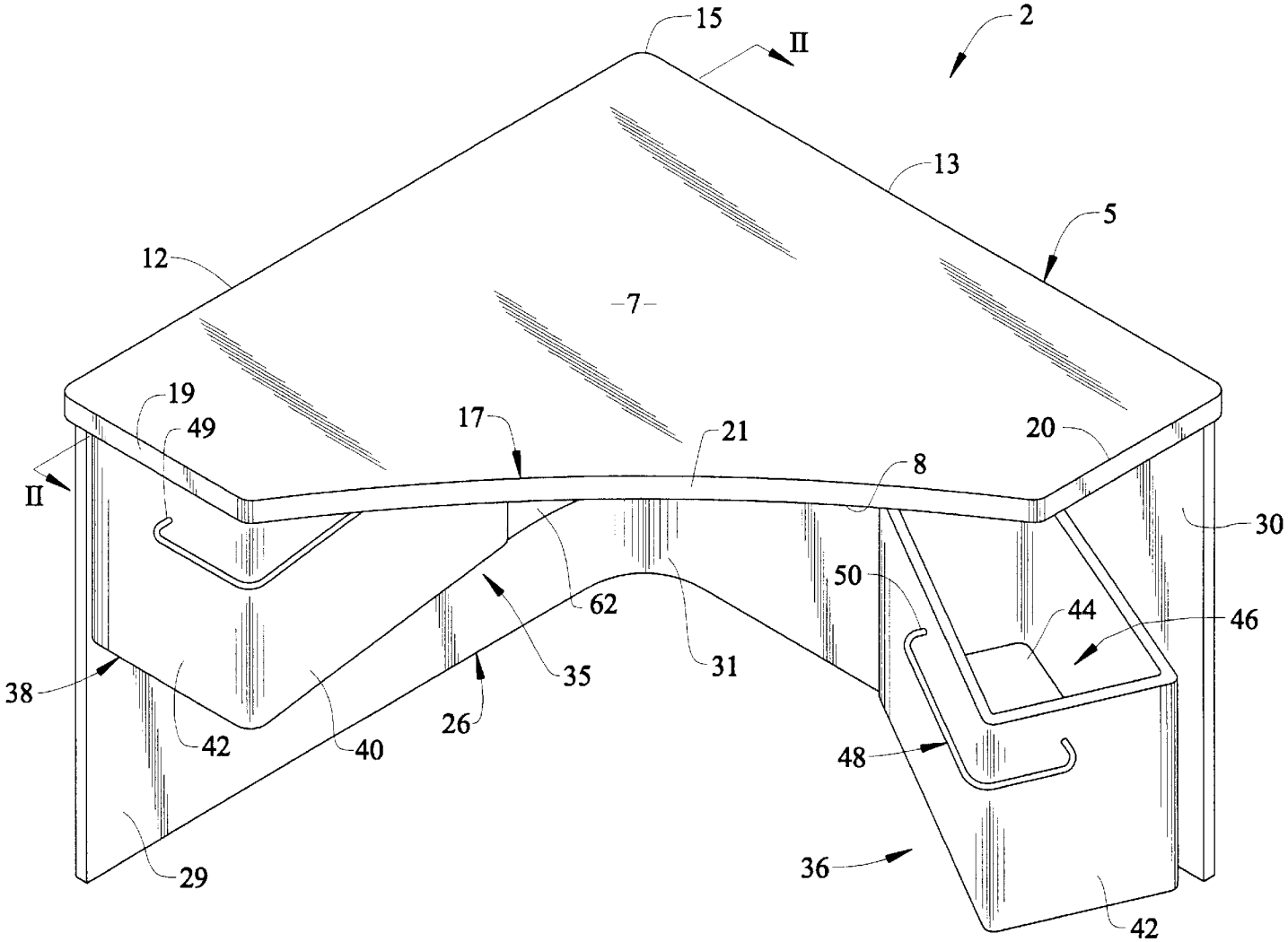
FIG. 1 is an upper front perspective view of a workstation constructed with pivoting and sliding drawers in accordance with the present invention.

With initial reference to FIG. 1, a workstation constructed in accordance with the present invention is generally indicated at 2. Workstation 2 is shown to take the form of a corner desk unit that can be used in various environments. However, as will become more readily apparent below, the present invention can be incorporated into various types of workstations without departing from the spirit thereof. As shown, workstation 2 includes a countertop 5 having an upper surface 7 and a lower surface 8 (also see FIG. 2). In the corner configuration shown, countertop 5 includes side edge portions 12 and 13 that extend forward from a common rear apex 15. Side edge portions 12 and 13 are joined by a frontal edge portion 17. Preferably, frontal edge portion 17 includes first and second sections 19 and 20 which extend substantially perpendicular to side edge portions 12 and 13 respectively, and a central section 21. Central section 21 interconnects first and second sections 19 and 20. As shown, central section 21 is slightly arcuate in the most preferred embodiment.

Workstation 2 also includes a base 26 for supporting countertop 5 above flooring (not labeled), with upper surface 7 of countertop 5 being arranged in a substantially horizontal plane. Base 26 is shown to include side panel portions 29 and 30 and a curved central panel portion 31. At this point, it should be recognized that the construction of base 26, as well as the actual configuration of countertop 5, can greatly vary without departing from the invention. For instance, countertop 5 can be rectangular and supported by vertical legs or even cantilevered from one or more walls.

More important to the present invention is the incorporation of one or more drawers as shown at 35 and 36 in workstation 2. Since drawers 35 and 36 are constructed so as to be substantially mirror images of one another, a single description will be made to the structure of drawers 35 and 36. Each drawer 35, 36 includes a housing 38 composed of integrated opposing side, front, rear and base walls 40–44 respectively. With this arrangement, housing 38 defines an internal storage compartment generally indicated at 46. As shown, each drawer 35, 36 includes a respective handle 48 including a first end 49 which is secured at front wall 42 and a second end 50 that is secured to side wall 40. With this arrangement, handle 48 extends across a portion of front wall 42, as well as a section of side wall 40. As will be detailed more fully below, this arrangement for handle 48 enhances the ability of a user to reposition a respective drawer 35, 36 in a convenient manner.

Each drawer 35, 36 is mounted to enable both pivoting and sliding movement relative to countertop 5. In FIG. 1, drawer 35 is shown fully retracted and positioned against side panel or leg portion 29 of base 26. For the sake of completeness, an arcuate cowling 62 is shown to extend generally across central section 21 under countertop 5 from adjacent rear wall 43 of drawer 35 towards drawer 36. When drawer 36 is positioned in the manner corresponding to that of drawer 35, cowling 62 simply enhances the overall aesthetic appearance of workstation 2.

Figure 2:
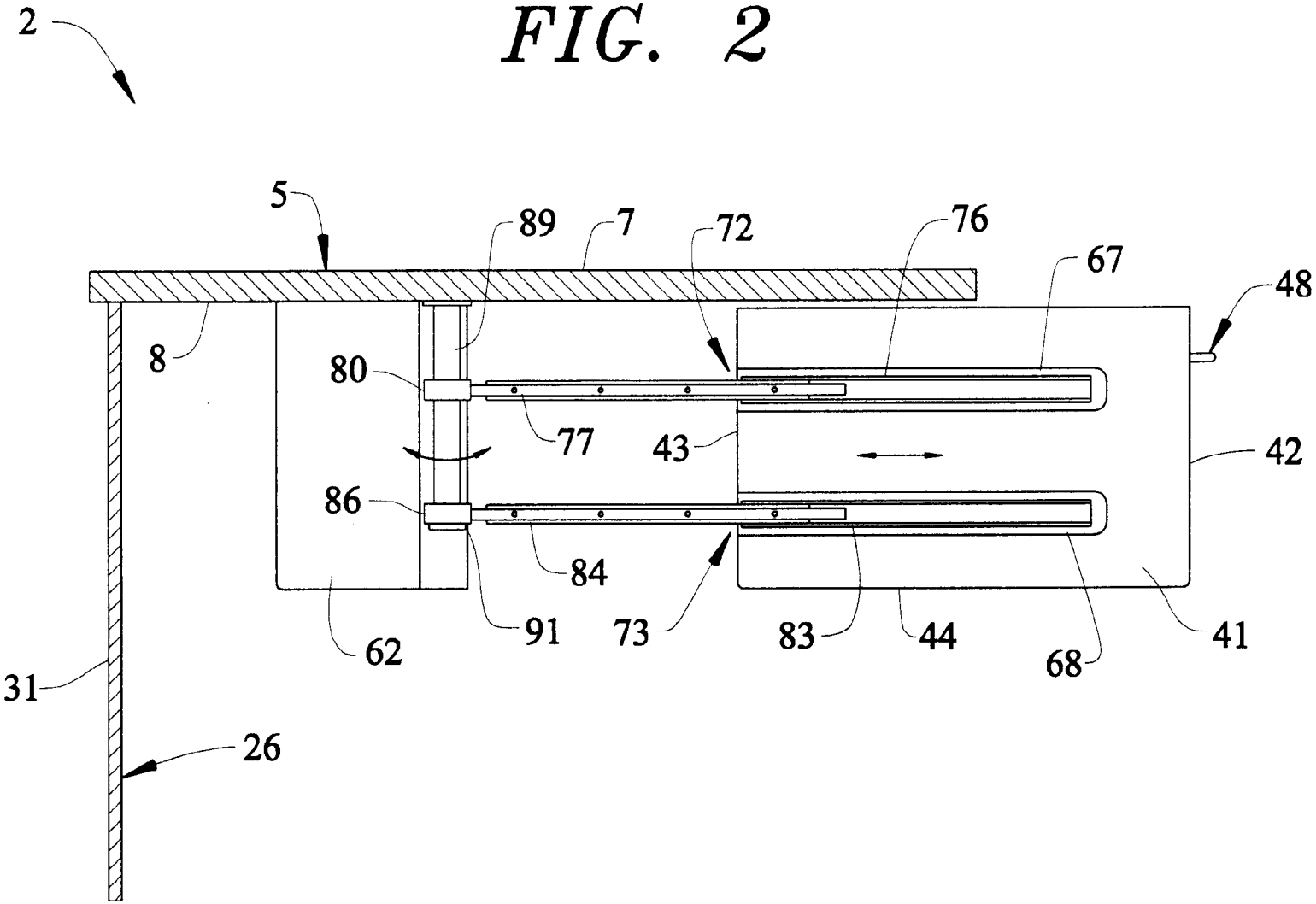
FIG. 2 is generally a cross-sectional view taken along line 11-11 of FIG. 1, but illustrating one of the drawers in a partially extended position.

With particular reference to FIG. 2 and the mounting of drawer 35, it is shown that side wall 41 is formed with upper and lower elongated recesses 67 sand 68. Recesses 67 and 68 cooperate with sets of rail members generally indicated at 72 and 73 respectively. More specifically, rail set 72 includes a first rail member 76 which is fixedly secured to housing 38 within upper recess 67 and a second rail member 77 which is slidably interconnected with first rail member 76. Second rail member 77 is also fixedly secured to a journal sleeve 80. In a similar manner, rail set 73 includes a first rail member 83 which is positioned within lower recess 68 and fixedly secured to housing 38, as well as a second rail member 84 which is slidably interconnected with first rail member 83 and which has fixedly attached thereto a respective journal sleeve 86. Each sleeve 80, 86 is mounted for rotation about an upright post 89 in a vertical space relationship as clearly shown in FIG. 2. More specifically, upright post 89 is preferably suspended from lower surface 8 of countertop 5 and sleeves 80 and 86 are freely received about upright post 89 prior to attachment of an end cap indicated at 91.

With this arrangement, drawer 35 can be shifted between a retracted position as shown in FIG. 1 to an extended position as shown in FIG. 2 due to the sliding interengagement of the sets of rail members 72 and 73. In general, these sets of rail members 72 and 73 are of a substantially conventional tongue and groove type arrangement, with both sets of rail members 72 and 73 being arranged on a common side wall 41 of a respective drawer 35, 36. Furthermore, due to the manner in which the sets of rail members 72 and 73 are attached to upright post 89 through sleeves 80 and 86, drawer 35 can pivot from against side panel portion 29 towards central section 21. FIG. 1 illustrates a partial pivoting movement of drawer 36 for exemplary purposes. FIG. 2 illustrates the positioning of upright post 89 relative to cowling 62 such that it should be readily apparent that cowling 62 does not interfere with the pivoting of either of drawers 35 or 36 even if the drawer 35, 36 is not extended prior to pivoting. That is, either drawer 35 or 36 can be individually extended, retracted or pivoted in accordance with the invention.

With this construction of workstation 2, an operator can readily access the contents of drawers 35 and 36 in a convenient manner. For example, either drawer 35 or 36 can be simply slid open upon the respective sets of rail members 72 and 73 by pulling on the portion of handle 48 that extends across front wall 42 in a manner somewhat analogous to a conventional drawer. However, drawers 35 and 36 can be simultaneously extended open and pivoted such as that illustrated for drawer 36. If a user of workstation 2 is sitting at a chair at central section 21, drawers 35 and 36 are spaced a sufficient distance so as to not limit the leg room of the user. However, since each handle 48 extends across a section of a respective side wall 40, each drawer 35, 36 can be readily pulled towards central section 21 by the user, while being simultaneously slid open in order to readily access internal storage compartment 46.

Although described with respect to a preferred embodiment of the invention, it should be readily understood that various changes and/or modifications can be made to the invention without departing from the spirit thereof. For example, although the sets of rail members 72 and 73 are preferably mounted to a side wall 41 of a respective drawer 35, 36, drawers 35 and 36 could be mounted for sliding movement in various other ways, such as having the rail members at top or bottom portions of the drawers 35 and 36, with each of the second rail members 77 and 84 being interconnected at inner terminal ends for a common attachment to a substantially vertical post. In addition to other types of sliding attachments for drawers 35 and 36, other pivoting connections could also be provided. For example, upright post 89 could be constituted by a pin of a common door hinge type assembly having one plate fixed to cowling 62 or a support suspending from countertop 5 and a second plate attached to a respective one of the second rail members 77 or 84. In any event, the invention is only intended to be limited by the scope of the following claims.

We claim:

1. A workstation comprising:

a countertop including a substantially planar upper surface and a lower surface, said countertop being arranged above a support surface with the upper surface extending in a substantially horizontal plane;

an upstanding post extending below the countertop and defining a substantially vertical axis;

at least one drawer arranged below said countertop, said drawer including a housing defining an internal storage compartment; and at least a first set of rail members, said first set of rail members including a first rail member fixed relative to the housing of said drawer and a second rail member pivotably attached to the upstanding post for rotation about the axis of the upstanding post, said first and second rail members being slidably interengaged, wherein said drawer is both movable between extended and retracted positions and pivotable relative to the countertop.

2. The workstation according to claim 1, wherein said housing includes first and second interconnected and spaced side walls, said first rail member being fixed to the first side wall.

3. The workstation according to claim 2, wherein the first side wall of said drawer is formed with a fore-to-aft extending recess, said first rail member being disposed in said recess.

4. The workstation according to claim 2, further including a second set of rail members interconnecting the drawer to the upstanding post, said first and second sets of rail members being vertically offset from one another.

5. The workstation according to claim 4, wherein the first side wall of said drawer is formed with upper and lower, fore-to-aft extending recesses, wherein a first rail member of each of said first and second sets of rail members is disposed in a respective one of said recesses.

6. The workstation according to claim 5, further comprising: a base including a side panel, said drawer being selectively movable from a laterally outward position wherein the first side wall of said drawer is substantially flush with the side panel.

7. The workstation according to claim 2, wherein the housing of the drawer further includes front, rear and base walls which are interconnected to the first and second side walls so as to define the internal compartment, said drawer including a handle which extends across portions of both the front wall and the second side wall.

8. The workstation according to claim 7, wherein the workstation constitutes a corner unit such that the countertop includes side edge portions extending substantially perpendicular from a common rear apex and a frontal edge portion extending between terminal ends of the side end portions remote from the apex, said frontal edge portion including first and second sections each extending at a first angle and for a certain distance from a respective one of the terminal ends of the side edge portions and a central section interconnecting the first and second sections, said drawer being adapted to be placed in a storage position below the first section of the countertop, said workstation including another pivotable and slidable drawer adapted to be placed in a storage position below the second section of said countertop.

9. A workstation comprising:

a countertop including a substantially planar upper surface and a lower surface;

means for supporting the countertop with the upper surface extending in a substantially horizontal plane;

at least one drawer including a housing defining an internal storage compartment; and means for mounting the drawer below said countertop for both pivoting and sliding movement relative to the countertop, wherein said mounting means includes an upstanding post, which extends below the countertop and defines a substantially vertical pivot axis, and a plurality of relatively slidable rail members interconnecting the drawer to the post.

10. The workstation according to claim 9, wherein the plurality of rail members includes a first rail member fixed relative to the housing of the drawer and a second rail member attached to the upstanding post for rotation about the axis of the upstanding post, said first and second rail members being slidably interengaged, wherein said drawer is both movable between extended and retracted positions and pivotable relative to the countertop.

11. The workstation according to claim 10, wherein said housing includes first and second interconnected and spaced side walls, said first rail member being fixed to the first side wall.

12. The workstation according to claim 11, wherein the first side wall of said drawer is formed with a fore-to-aft extending recess, said first rail member being disposed in said recess.

13. The workstation according to claim 11, further including a second set of rail members interconnecting the drawer to the upstanding post, said first and second sets of rail members being vertically offset from one another.

14. The workstation according to claim 13, wherein the first side wall of said drawer is formed with upper and lower, fore-to-aft extending recesses, wherein the first rail member of each of said first and second sets of rail members is disposed in a respective one of said recesses.

15. The workstation according to claim 14, further comprising: a base including a side panel, said drawer being selectively movable from a laterally outward position wherein the first side wall of said drawer is substantially flush with the side panel.

16. The workstation according to claim 11, wherein the housing of the drawer further includes front, rear and base walls which are interconnected to the first and second side walls so as to define the internal compartment, said drawer including a handle which extends across portions of both the front wall and the second side wall.

17. The workstation according to claim 16, wherein the workstation constitutes a corner unit such that the countertop includes side edge portions extending substantially perpendicular from a common rear apex and a frontal edge portion extending between terminal ends of the side end portions remote from the apex, said frontal edge portion including first and second sections each extending at a first angle and for a certain distance from a respective one of the terminal ends of the side edge portions and a central section interconnecting the first and second sections, said drawer being adapted to be placed in a storage position below the first section of the countertop, said workstation including another pivotable and slidable drawer adapted to be placed in a storage position below the second section of said countertop.

* * * * *